US007141143B2

(12) United States Patent
Juutinen

(10) Patent No.: US 7,141,143 B2
(45) Date of Patent: Nov. 28, 2006

(54) METHOD AND APPARATUS FOR DRAINING FIBRE PULP SUSPENSION

(75) Inventor: Vesa Juutinen, Tampere (FI)

(73) Assignee: Metso Paper, Inc., Helsinki (FI)

( * ) Notice: Subject to any disclaimer, the term of this patent is extended or adjusted under 35 U.S.C. 154(b) by 182 days.

(21) Appl. No.: 10/815,328

(22) Filed: Apr. 1, 2004

(65) Prior Publication Data

US 2004/0188051 A1 Sep. 30, 2004

Related U.S. Application Data

(63) Continuation of application No. PCT/FI02/00779, filed on Oct. 3, 2002.

(30) Foreign Application Priority Data

Oct. 3, 2001 (FI) ..... 20011934

(51) Int. Cl.

| | |
|---|---|
| ***D21F 1/00*** | (2006.01) |
| ***D21F 1/80*** | (2006.01) |
| ***D21F 1/50*** | (2006.01) |
| ***D21F 1/52*** | (2006.01) |
| *D21C 9/18* | (2006.01) |

(52) U.S. Cl. ..... 162/208; 162/210; 162/211; 162/217; 162/301; 162/351; 162/352

(58) Field of Classification Search ..... 162/203, 162/208–211, 217, 351, 352, 356, 295, 300, 162/301, 297, 303, 304

See application file for complete search history.

(56) References Cited

U.S. PATENT DOCUMENTS

| | | | | |
|---|---|---|---|---|
| 1,699,487 | A * | 1/1929 | Hinde | 162/301 |
| 3,450,596 | A * | 6/1969 | Green | 162/338 |
| 4,306,934 | A * | 12/1981 | Seppanen | 162/209 |
| 4,999,087 | A * | 3/1991 | Ebihara et al. | 162/301 |
| 5,248,392 | A * | 9/1993 | Bando et al. | 162/301 |
| 5,389,206 | A * | 2/1995 | Buck et al. | 162/301 |
| 5,395,484 | A * | 3/1995 | Odell et al. | 162/203 |
| 5,456,803 | A * | 10/1995 | Tokuno | 162/304 |
| 5,735,330 | A * | 4/1998 | Buchmann et al. | 162/301 |
| 5,833,809 | A | 11/1998 | Odell | |
| 5,871,617 | A * | 2/1999 | Iwata et al. | 162/301 |
| 5,935,382 | A * | 8/1999 | Huovila et al. | 162/123 |
| 6,183,602 | B1 * | 2/2001 | Iwata et al. | 162/301 |
| 6,309,511 | B1 * | 10/2001 | Iwata et al. | 162/352 |
| 6,475,343 | B1 * | 11/2002 | Grabscheid et al. | 162/207 |

OTHER PUBLICATIONS

S.I. Green; *Modelling Suction Shoes in Twin-Wire Forming: Results*' Journal of Pulp and Paper Science; Feb. 2000; pp. 53-58; vol. 26, No. 2.

International Search Report for corresponding International Application No. PCT/FI02/00779.

* cited by examiner

*Primary Examiner*—Eric Hug
(74) *Attorney, Agent, or Firm*—Metso Paper, Inc.

(57) ABSTRACT

The invention relates to a method of draining a fiber pulp suspension, where the fiber pulp suspension is applied to a convergent dewatering space arranged between two wires travelling in the same direction. In the dewatering space, water and powdery substance are removed from the fiber pulp suspension through the wires. Pressure pulses are generated in the fiber pulp suspension along the length of the dewatering space with pressure pulse elements that are on opposite sides of the wires relative to the fiber pulp suspension and in contact with or at a distance from the wires. The invention also relates to an apparatus according to the method.

8 Claims, 7 Drawing Sheets

METHOD AND APPARATUS FOR DRAINING FIBRE PULP SUSPENSION

CROSS-REFERENCE TO RELATED APPLICATIONS

This application is a continuation of International Application PCT/FI02/00779 filed on Oct. 3, 2002, which designated the U.S. and was published under PCT Article 21(2) in English, and which is hereby incorporated herein in its entirety by reference.

BACKGROUND OF THE INVENTION

The present invention relates to a method of draining a fibre pulp suspension, in which method the fibre pulp suspension is applied to a dewatering space arranged between a first wire and a second wire, water and powdery substance are removed from the suspension in the dewatering space through the wires that travel in the same direction as the fibre pulp suspension, whereby the wires are arranged to travel in such a manner that the dewatering space converges from the pulp feed end towards the discharge end, and pressure pulses are generated in the fibre pulp suspension along the length of the dewatering space with pressure pulse elements that are on opposite sides of the wires relative to the fibre pulp suspension and in contact with or at a distance from the wires.

The present invention also relates to an apparatus for draining a fibre pulp suspension, the apparatus comprising a dewatering space that is defined by a first wire and a second wire travelling in its longitudinal direction and to whose one end the fibre pulp suspension is applied and, correspondingly, the fibre pulp suspension is discharged from a second end in such a manner that water is removed from the fibre pulp suspension in the dewatering space, the dewatering space being arranged between the wires, and water and powdery substance are removed through both wires, and that it comprises elements for generating pressure pulses in the fibre pulp suspension while it is in the dewatering space.

In known solutions, the fibre pulp suspension is led after the feeder chamber of the former to the former for dewatering of the fibre pulp suspension, whereby a fibre web is formed from the fibre pulp suspension in the former. The former typically comprises an upper and lower wire, a fibre pulp suspension jet being directed from the feeder chamber to the roll gap formed by the upper and lower wires. In the former, water is typically removed by recovering the water drained upwards through the wire by means of doctor blades or drainage foils. Under the lower wire is arranged a so-called forming shoe composed of for instance two separately adjustable suction chambers by means of which water is removed downwards. Against the wire, transversely to its travel direction, the forming shoe comprises drainage foils for enhancing the dewatering. The weakness of such a foil former is low dewatering capacity, which is caused by the limited capability of the dewatering elements to remove water through the wires and by the premature drainage of the fibre mat on the surface of the wires caused by the dewatering elements, whereby water is prevented from passing through the wires. For this reason, at the start, the dewatering has to be carried out extremely carefully to prevent premature drainage, and thus the dewatering area of the former has to be quite long. This makes the former large and, consequently, expensive and bulky.

BRIEF DESCRIPTION OF THE INVENTION

The object of the present invention is to provide a very efficient and well working former with none of the above drawbacks.

The method of the invention is characterized by generating a pressure pulse in the direction of the dewatering space between the wires with the pressure pulse element that is in contact with or at a distance from the first wire, and, simultaneously and at the same point relative to the travel direction of the wires, generating a suction pulse for amplifying said pressure pulse in the dewatering space between the wires with the pressure pulse element that is in contact with or at a distance from the second wire.

The apparatus of the invention is characterized in that at least one pressure pulse element is arranged at the first wire such that this pressure pulse element generates a pressure pulse in the dewatering space between the wires and that at least one pressure pulse element is arranged at the second wire such that the pressure pulse element generates a suction pulse for amplifying said pressure pulse in the dewatering space between the wires, simultaneously and at the same point relative to the travel direction of the wires.

The essential idea of the invention is to feed the fibre pulp suspension from the formed feeder chamber between two wires, pressure pulse elements in contact with or at a distance from them generating a pressure pulse in the direction of the dewatering space between the wires such that when the pressure pulse element in contact with the first wire generates a pressure pulse in the direction of the dewatering space between the wires, the pressure pulse element in contact with the second wire generates a suction pulse for amplifying said pressure pulse in the dewatering space between the wires, simultaneously and at the same point relative to the travel direction of the wires.

Furthermore, the essential idea of a solution according to an embodiment of the invention is to apply the fibre pulp suspension to a dewatering chamber that has closed sides and through which the wires travel, so that a convergent dewatering space forms between them.

The idea of a solution of yet another embodiment of the invention is to generate the pressure pulse directed to the dewatering space and the immediately thereafter-occurring pressure pulse that is directed away from the dewatering space with different pressure pulse elements, so that together they simultaneously achieve pressure pulses that amplify each other and are directed to the dewatering space.

An advantage of the invention is that, in this way, the dewatering capability of the dewatering elements is substantially better because of their combined effect, which prevents the premature creation of a tight fibre mat on the surface of the wires.

BRIEF DESCRIPTION OF THE FIGURES

The invention is described in detail in the attached drawings, wherein.

In the figures, the invention is presented in a simplified manner for the sake of clarity. In the figures, like reference numbers denote like parts.

DETAILED DESCRIPTION OF THE INVENTION

Figure 1:
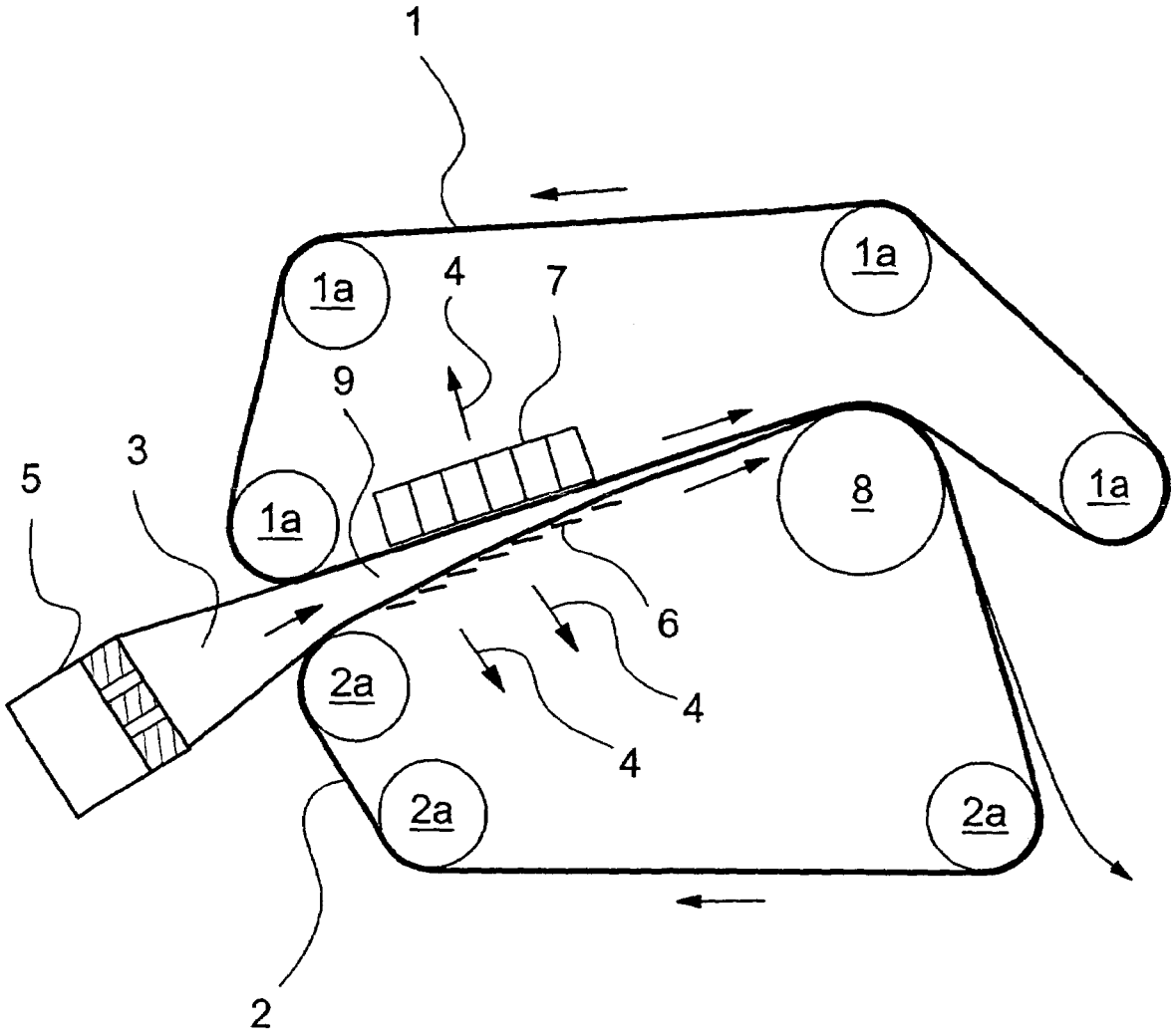
FIG. 1 is a schematic sectional side view in the travel direction of the wires of an embodiment of a prior art former.

FIG. 1 is a schematic sectional side view in the travel direction of the wires of an embodiment of a prior art former. The figure shows a first wire 1, which loops around guide rolls 1*a*. It also shows a second wire 2, which similarly loops as a closed loop around a hitch roll 8 and guide rolls 2*a*, and supported by which fibre pulp suspension 3 is conveyed in the web forming section while being dewatered. In the figure, arrows 4 schematically show the discharge of water. A jet from a feeder chamber 5 is applied to a space between the first wire 1 and the second wire 2, whereby the fibre pulp suspension 3 is drained in a dewatering space 9 in both directions. Drainage foils 6 under the second wire 2 are used to press the wires against suction boxes 7 on the side of the first wire 1, whereby pressure pulses are generated in the web and water 4 is removed to the side of the first wire 1 by means of motion energy and the vacuum in the suction boxes 7. The water 4 is discharged to the side of the second wire 2 by means of the vacuum provided by the drainage foils 6.

Figure 2A:
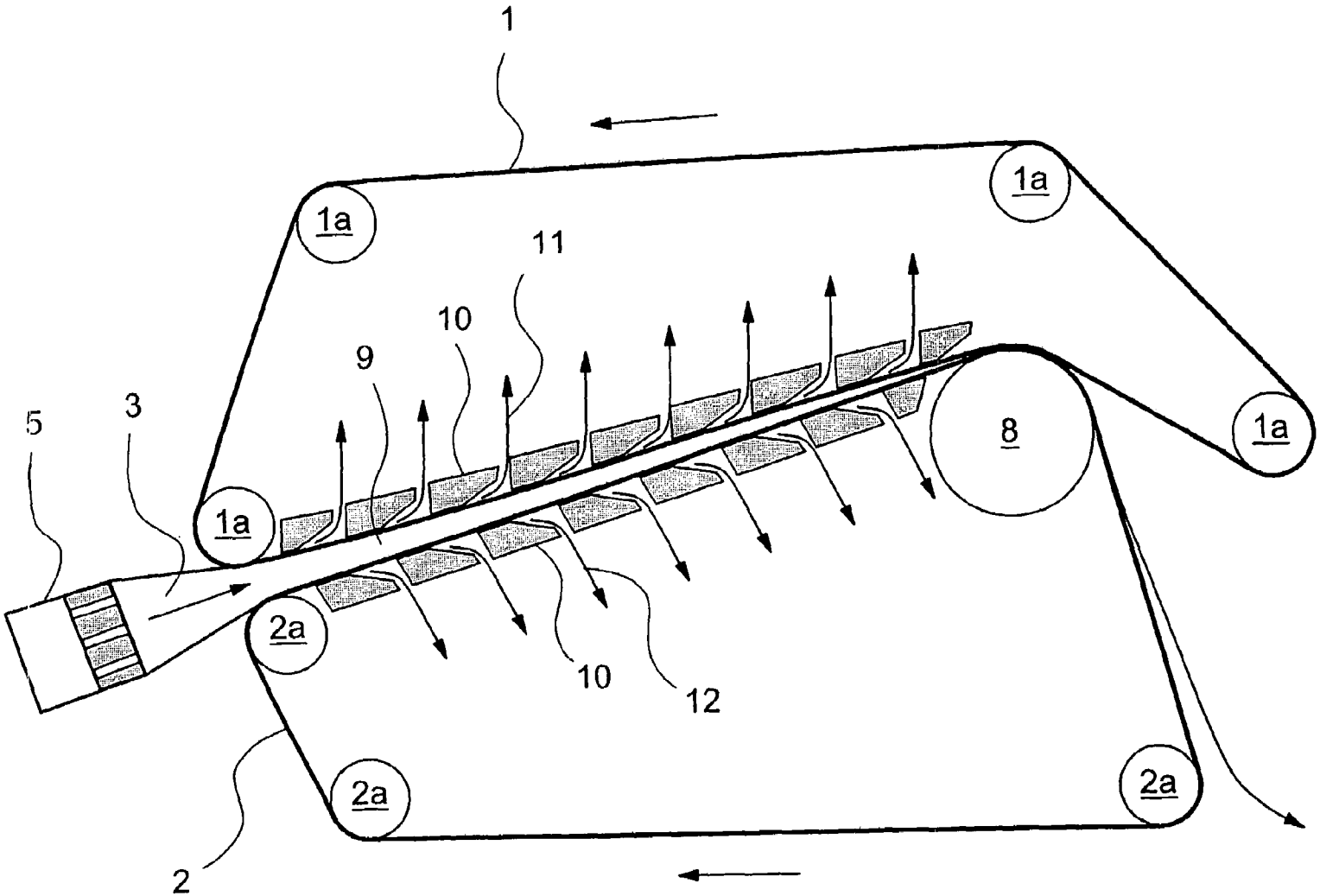
FIGS. 2*a*, 2*b*, and 2*c* are schematic sectional side views in the travel direction of the wires of an embodiment of a former of the invention.
Figure 2B:
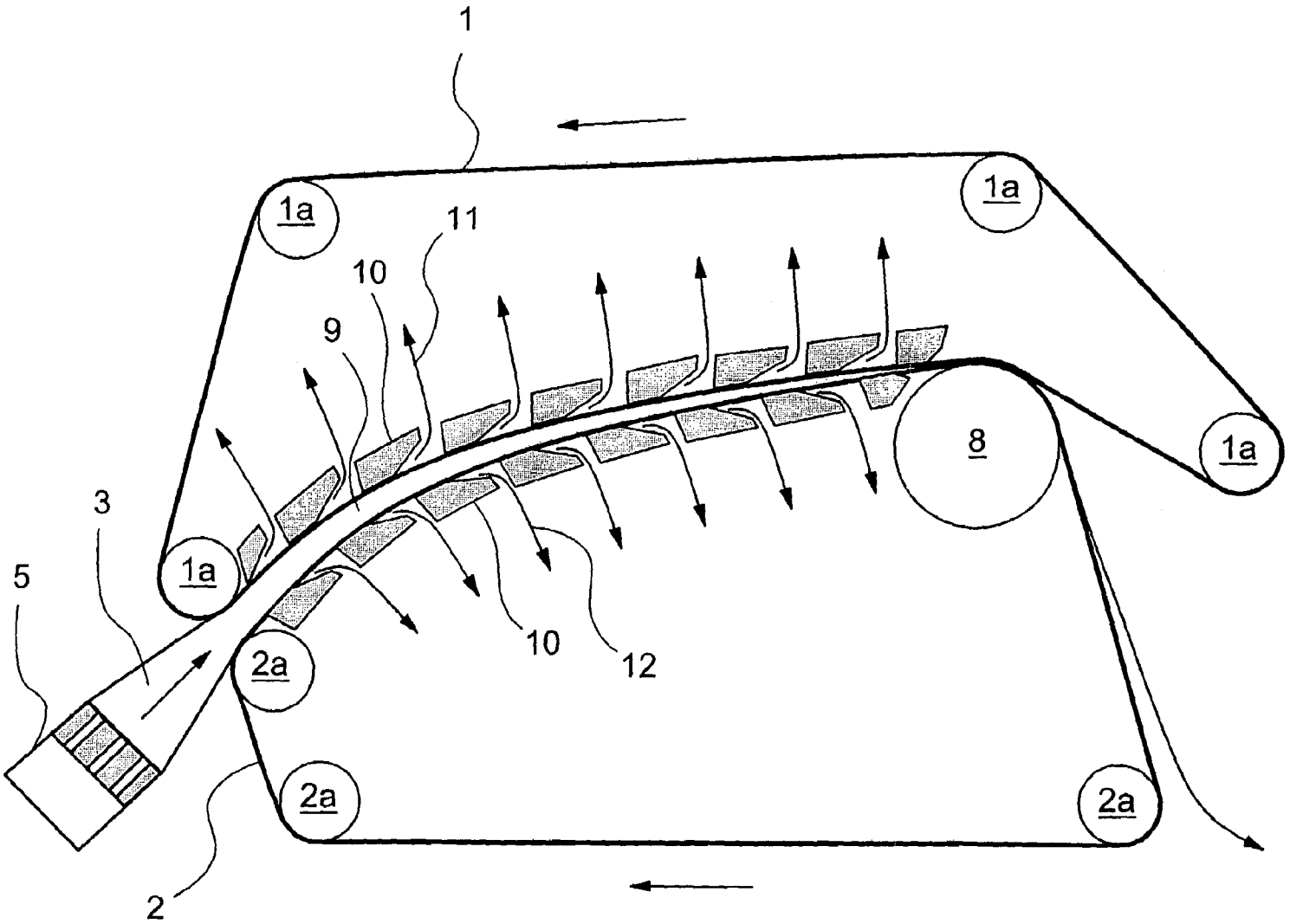
Figure 2C:
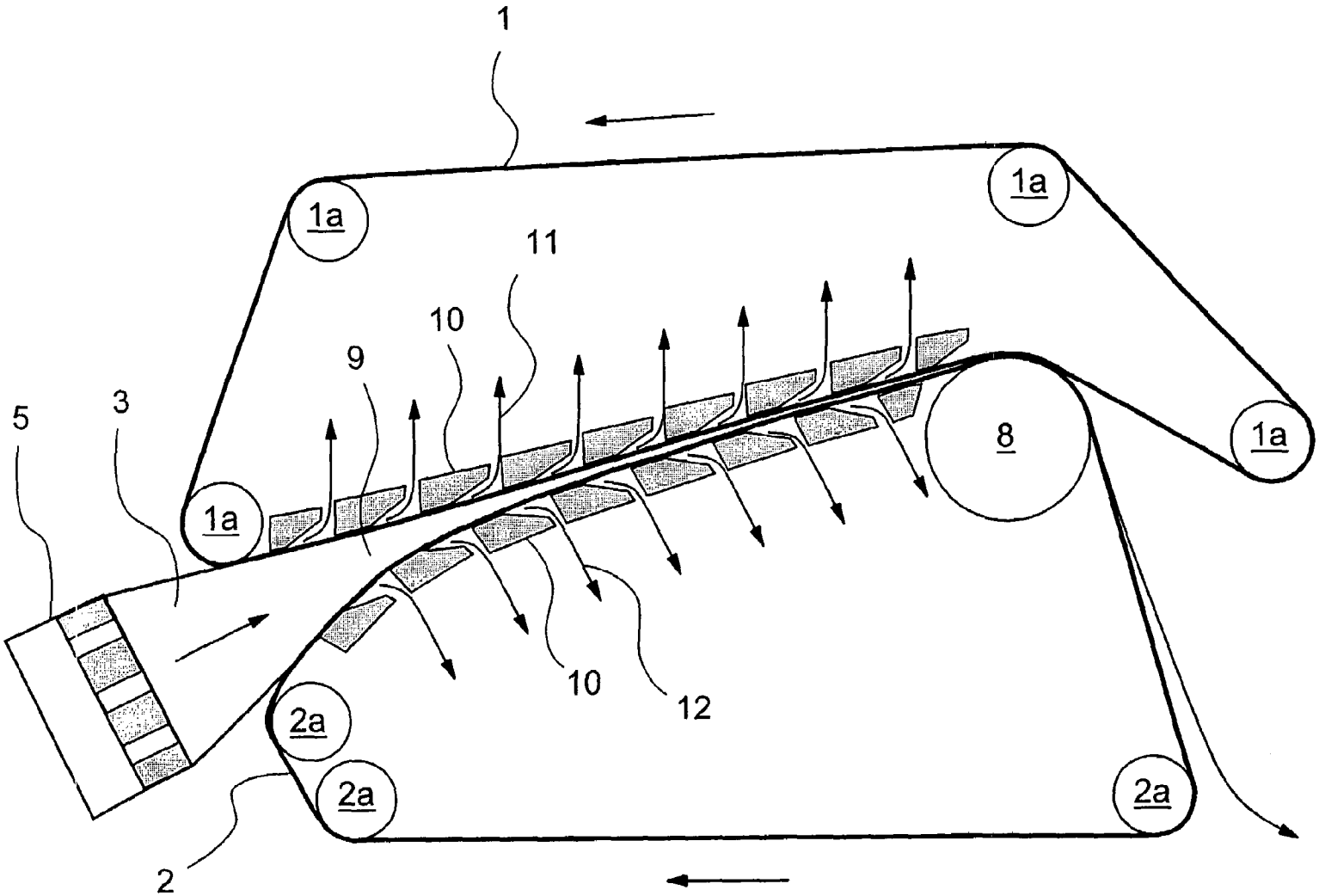

FIGS. 2*a*, 2*b*, and 2*c* are schematic sectional side views in the travel direction of the wires of an embodiment of a former of the invention. FIG. 2*a* shows a first wire 1 looping as a closed loop around guide rolls 1*a*. It also shows a second wire 2, which similarly loops as a closed loop around a hitch roll 8 and guide rolls 2*a*. The number and location of guide rolls may be any suitable, which is generally known per se and self-evident to a person skilled in the art. A convergent dewatering space 9 forms between the wires 1 and 2, into which a fibre pulp suspension jet 3 is applied from a feeder chamber 5. On both sides of the dewatering space 9, against the outer surface of the wires 1 and 2, are pressure pulse elements 10, via which water is discharged from the fibre pulp suspension 3 in the dewatering space 9 in the manner schematically shown by arrows 11 and 12. FIG. 2*b* shows a sectional side view of a second embodiment of a former of the invention, where the surfaces of the convergent dewatering space 9 on the side of the wires 1 and 2 are curved relative to the travel direction of the wires. FIG. 2*c* shows a third embodiment of a former of the invention, where the surface of the convergent dewatering space 9 on the side of the first wire 1 is straight relative to the travel direction of the wires, the surface on the second wire 2 being curved.

Figure 3:
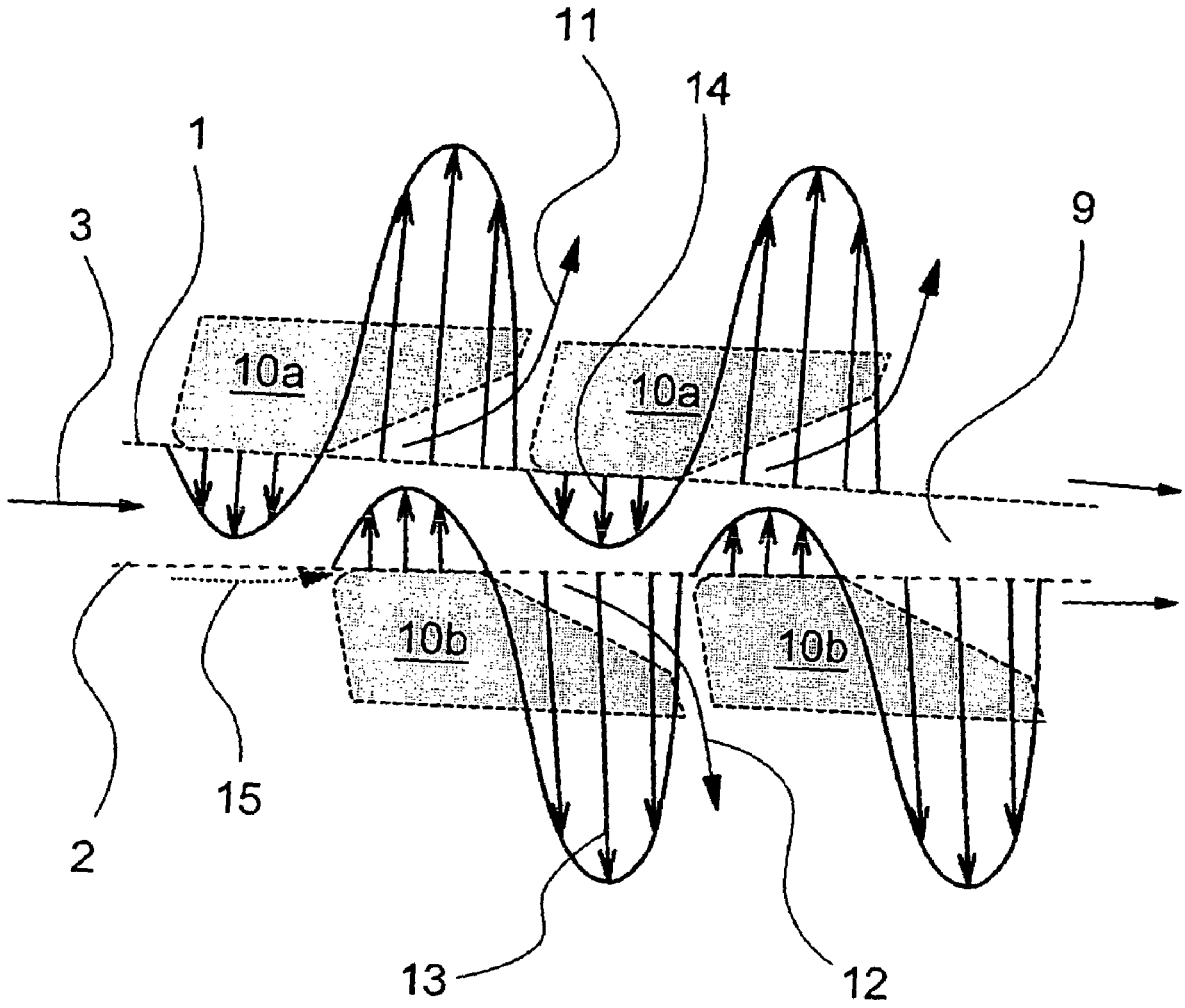
FIG. 3 is a closer schematic sectional side view in the travel direction of the wires of the pressure pulse elements of an apparatus suitable for implementing the method of the invention.

FIG. 3 is a closer schematic sectional side view in the travel direction of the wires of the pressure pulse elements of an apparatus suitable for implementing the method of the invention. The figure shows a first wire 1 and a second wire 2, between which forms a convergent dewatering space 9 into which a fibre pulp suspension jet 3 is applied from a feeder chamber. The Figure does not show the feeder chamber. On both sides of the dewatering space 9. against the outer surface of the wires 1 and 2, are pressure pulse elements 10*a* and 10*b*, which generate pressure pulses in the dewatering space 9 in the manner schematically shown by arrows 13 and 14. The pressure pulse elements 10*a* and 10*b* are arranged against the outer surfaces of the wires 1 and 2 on both sides of the dewatering space 9 such that when the pressure pulse element 10*a* (or a positive pressure pulse portion thereof) in contact with the first wire 1 generates a pressure pulse 14 in the direction of the dewatering space 9 between the wires, the pressure pulse being called a positive pressure pulse in the present invention, then, simultaneously, the pressure pulse element 10*b* (or a negative pressure pulse portion thereof) in contact with the second 2 wire generates a suction pulse 13 that amplifies said pressure pulse 14 in the dewatering space 9, such suction pulse being called a negative pressure pulse in the present invention. The pressure pulse is generated because filtered water on the outer surface of the wire, having penetrated the wire, but being carried with it, hits the front surface of the pressure pulse element in contact with the outer surface of the wire. The front surface of the pressure pulse element is preferably shaped such that the surface guides the water to return to the dewatering space between the wires. The generation of a pressure pulse by a pressure pulse element is a wellknown phenomenon to a person skilled in the art, and selfevident to the skilled artisan, and is not described in detail herein. The negative and positive pressure pulses 13 and 14 generate local draws in the draining fibre pulp suspension 3, which draws produce shear forces that fiberize fibre flocks in the fibre pulp suspension 3 and thus cause turbulence in the dewatering space 9 between the wires 1 and 2. This turbulence prevents the fibre mat from being drained onto the surface of the wires 1 and 2, and since less fibre is drained on the surface of the wires 1 and 2, the discharge of water increases from the dewatering space 9 through the wires 1 and 2. In the figure, the discharge of water through the wires is schematically shown by arrows 11 and 12.

Figure 4A:
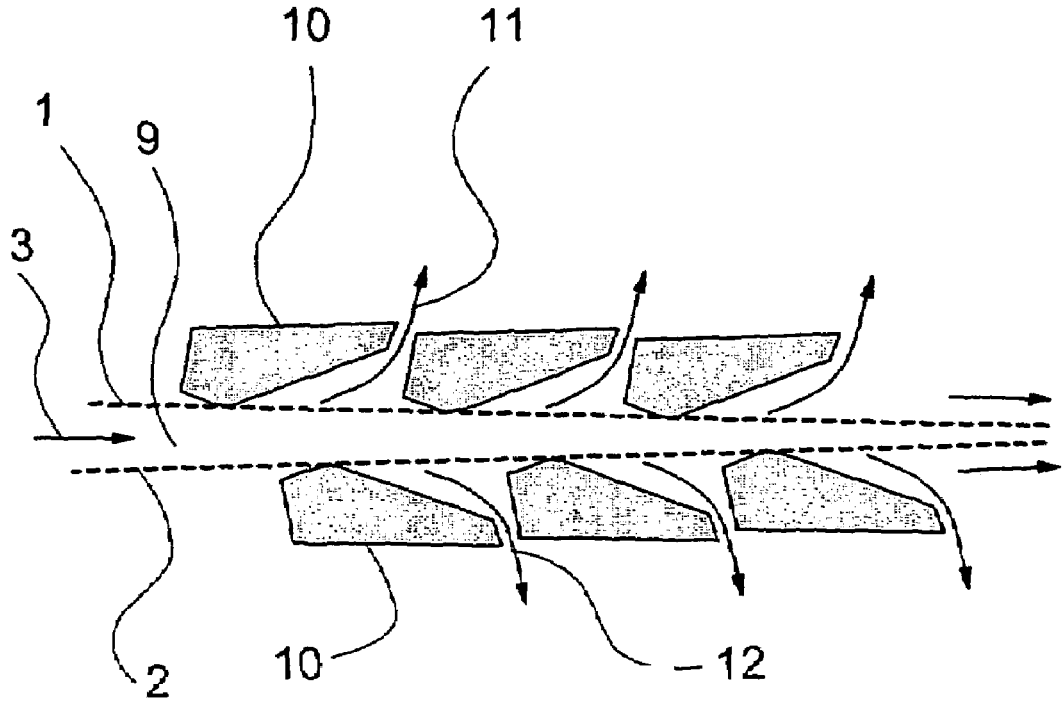
FIGS. 4*a* and 4*b* are schematic sectional side views in the travel direction of the wires of the pressure pulse elements arranged in an apparatus of the invention, and FIG. 5 schematically shows the test results obtained with an apparatus of the invention.
Figure 4B:
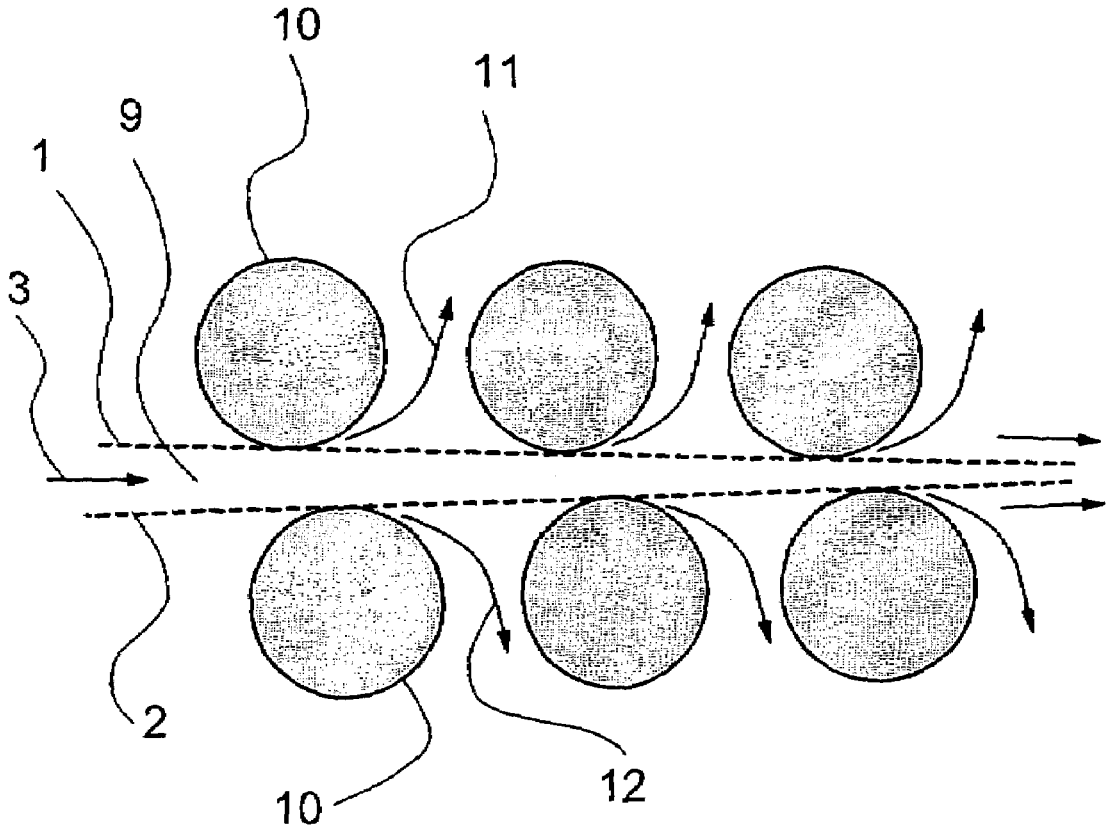

FIGS. 4*a* and 4*b* are schematic sectional side views in the travel direction of the wires of the pressure pulse elements arranged in an apparatus of the invention. The figures show a first wire 1 and a second wire 2, between which forms a dewatering space 9 into which the fibre pulp suspension 3 is applied. On both sides of the dewatering space 9, against the outer surface of the wires 1 and 2, are pressure pulse elements 10, via which water is discharged from the fibre pulp suspension 3 in the dewatering space 9 in the manner schematically shown by arrows 11 and 12. It is essential to the pressure pulse elements 10 used in the apparatus of the invention that the pressure pulse element 10 generates at least two pressure pulses that amplify each other, one of them being directed to the dewatering space 9 between the wires 1 and 2, and the other being directed away from the dewatering space 9. The pressure pulse elements 10 may be, for example, drainage foils as shown in FIG. 4*a*, or rolls as shown in FIG. 4*b*, wherein the rolls may be rotating or non-rotating. Further, one skilled in the art will appreciate that various combinations of such pressure pulse elements 10 may implemented on either side of the dewatering space 9 (i.e., the pressure pulse element 10 or portion thereof generating the positive pressure pulse on one side of the dewatering space 9 may be different from the pressure pulse element 10 or portion thereof, generating the coinciding negative pressure pulse along the dewatering space 9, on the other side of the dewatering space 9), as well as along the dewatering space 9 (i.e., the pressure pulse element 10 or portion thereof generating the positive pressure pulse on one side of the dewatering space 9 or the pressure pulse element 10 or portion thereof generating the coinciding negative pressure pulse at a first position along the dewatering space 9 on the other side of the dewatering space 9, may be different from either of the pressure pulse elements 10 or portions thereof generating the coinciding positive and negative pulses at a second position along the dewatering space 9).

Figure 5:
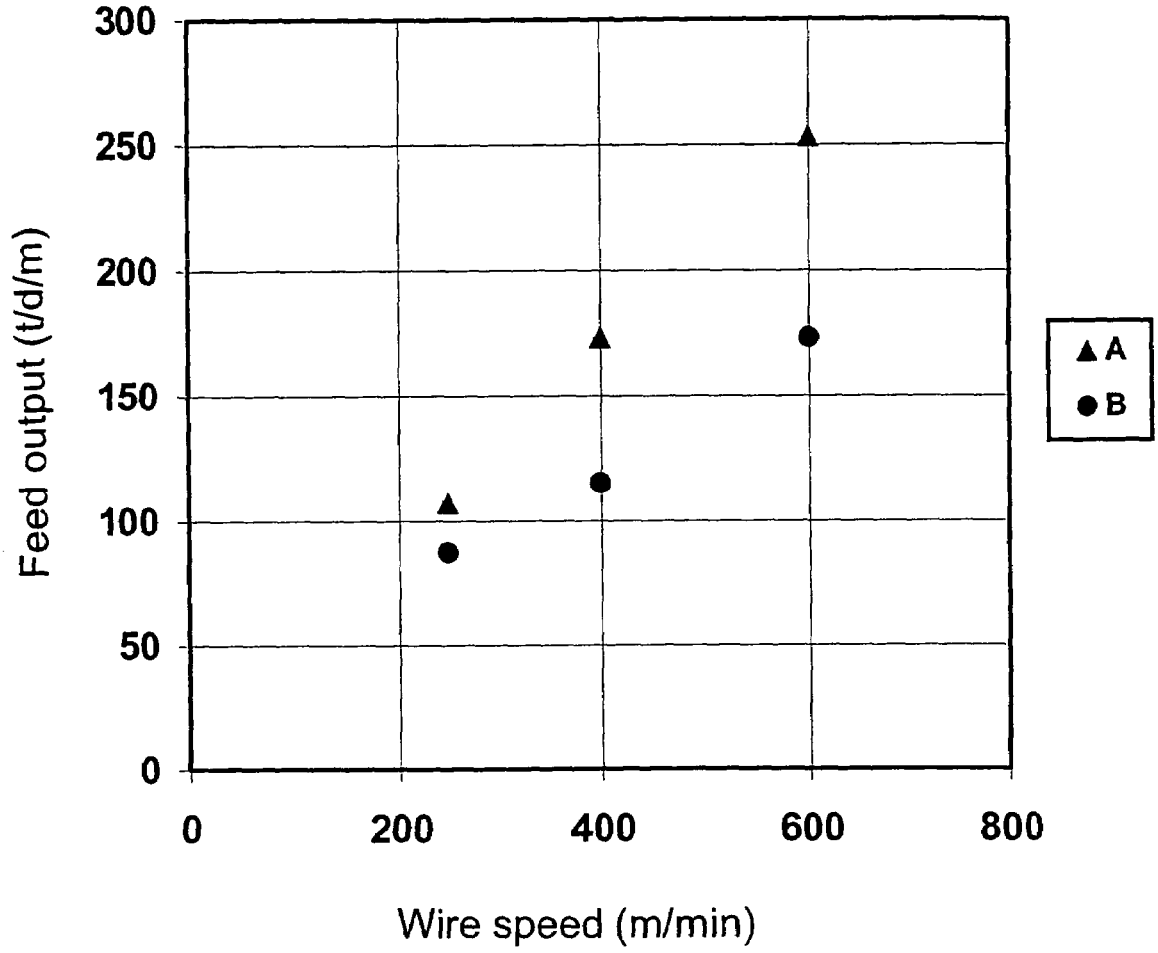

FIG. 5 schematically shows the test results obtained with an apparatus of the invention. In the figure, the feed output obtained with an apparatus A of the invention is compared with a prior art B apparatus as a function of wire speed. As FIG. 5 shows, as wire speed increases, the feed output also increases, i.e. the amount of fibre pulp suspension treated with the former, i.e. former capacity increases with the apparatus of the invention up to as much as one and a half times compared with the capacity of a prior art apparatus. This shows that, compared with prior art apparatuses, the apparatus of the invention is extremely efficient.

In the above description and in the drawings, the invention is described only by way of example and it is in no way restricted to it, but the scope of protection is as defined in the claims.

The invention claimed is:

1. A method of draining a fiber pulp suspension in a converging dewatering space defined between a first wire and a second wire each traveling from a pulp feed end toward a discharge end of the dewatering space, the dewatering space being configured such that water and a powdery substance are removed from the fiber pulp suspension through the first and second wires conveying the fiber pulp suspension along the dewatering space, the first and second wires having first and second pressure pulse elements, respectively, disposed adjacent thereto opposite the corresponding wire from the dewatering space, said method comprising:

generating a positive pressure pulse directed toward the denaturing space with a positive pressure pulse portion of one of the first and second pressure pulse elements; and generating a negative pressure pulse in coincidence with the positive pressure pulse along the dewatering space, the negative pressure pulse being directed away from the dewatering space and being generated with a negative pressure pulse portion of the other of the first and second pressure pulse elements, such that the negative pressure pulse constructively interferes with and amplifies the positive pressure pulse through the dewatering space.

2. A method according to claim 1 wherein generating a positive pressure pulse and generating a negative pressure pulse further comprise generating a positive pressure pulse in coincidence with a negative pressure pulse along the dewatering space within a close-sided dewatering chamber.

3. A method according to claim 1 wherein generating a positive pressure pulse further comprises generating a positive pressure pulse with a positive pressure pulse portion of one of the first and second pressure pulse elements, the one of the first and second pressure pulse elements comprising at least one of a drainage foil, a rotating roll, and a nonrotating roll.

4. A method according to claim 1 wherein generating a negative pressure pulse further comprises generating a negative pressure pulse with a negative pressure pulse portion of the other of the first and second pressure pulse elements, the other of the first and second pressure pulse elements comprising at least one of a drainage foil, a rotating roll, and a non-rotating roll.

5. An apparatus for draining a fiber pulp suspension in a converging dewatering space configured such that water and a powdery substance are removed from the fiber pulp suspension through the first and second wires conveying the fiber pulp suspension along the dewatering space, said apparatus comprising:

a first wire and a second wire cooperating to define a converging dewatering space therebetween, the first and second wires each traveling from a pulp feed end toward a discharge end of the dewatering space; and a first pressure pulse element and a second pressure pulse element disposed adjacent to the first and second wires, respectively, opposite the corresponding wire from the dewatering space, a positive pressure pulse portion of one of the first and second pressure pulse elements being configured to generate a positive pressure pulse directed toward the dewatering space, and a negative pressure pulse portion of the other of the first and second pressure pulse elements being configured to generate a negative pressure pulse in coincidence with the positive pressure pulse along the dewatering space, the negative pressure pulse being directed away from the dewatering space, such that the negative pressure pulse constructively interferes with and amplifies the positive pressure pulse through the dewatering space.

6. An apparatus according to claim 5 further comprising a close-sided dewatering chamber configured to house the dewatering space defined by the first and second wires.

7. An apparatus according to claim 5 wherein the one of the first and second pressure pulse elements comprises at least one of a drainage foil, a rotating roll, and a non-rotating roll.

8. An apparatus according to claim 5 wherein the other of the first and second pressure pulse elements comprises at least one of a drainage foil, a rotating roll, and a non-rotating roll.

* * * * *